US008446100B2

(12) United States Patent
Garufo

(10) Patent No.: US 8,446,100 B2
(45) Date of Patent: May 21, 2013

(54) INTERCONNECTED ARRANGEMENT OF INDIVIDUAL MODULES HAVING AT LEAST ONE LIGHT-EMITTING DIODE CHIP

(75) Inventor: Gabriel Garufo, Landshut (DE)

(73) Assignee: Vossloh-Schwabe Optoelektronik GmbH & Co. KG (DE)

( * ) Notice: Subject to any disclaimer, the term of this patent is extended or adjusted under 35 U.S.C. 154(b) by 1263 days.

(21) Appl. No.: 12/096,899

(22) PCT Filed: Dec. 29, 2006

(86) PCT No.: PCT/EP2006/012591

§ 371 (c)(1),
(2), (4) Date: Aug. 5, 2008

(87) PCT Pub. No.: WO2007/077007

PCT Pub. Date: Jul. 12, 2007

(65) Prior Publication Data

US 2009/0051301 A1 Feb. 26, 2009

(30) Foreign Application Priority Data

Jan. 3, 2006 (DE) ..... 10 2006 000 810

(51) Int. Cl.
*H05B 37/02* (2006.01)

(52) U.S. Cl.
USPC ..... 315/291

(58) Field of Classification Search
USPC 315/209 R, 224, 225, 291, 307, 169.1–169.3
See application file for complete search history.

(56) References Cited

U.S. PATENT DOCUMENTS

| | | | | |
|---|---|---|---|---|
| 6,515,434 | B1 * | 2/2003 | Biebl | 315/291 |
| 6,747,617 | B1 * | 6/2004 | Kawashima | 345/76 |
| 6,798,152 | B2 * | 9/2004 | Rooke et al. | 315/209 R |
| 6,982,527 | B2 | 1/2006 | Lee et al. | |
| 7,002,547 | B2 | 2/2006 | Yamada | |
| 7,122,971 | B2 | 10/2006 | Yeh et al. | |
| 7,322,718 | B2 | 1/2008 | Setomoto et al. | |
| 7,365,718 | B2 | 4/2008 | Tsuchida et al. | |
| 2004/0155604 | A1 * | 8/2004 | Kobayashi | 315/291 |

FOREIGN PATENT DOCUMENTS

| | | |
|---|---|---|
| DE | 103 18 780 | 12/2004 |
| EP | 1 079 667 | 2/2001 |

* cited by examiner

*Primary Examiner* — Jimmy Vu
(74) *Attorney, Agent, or Firm* — Robert Becker; Becker & Stachniak

(57) ABSTRACT

An interconnected arrangement of a light-emitting diode chip arrangement having individual modules as luminous elements in a parallel circuit. Each module is provided with at least one light-emitting diode chip, and the modules are arranged in a parallel circuit. A respective linear constant current circuit connects each light-emitting diode chip arrangement to a common, current-carrying voltage source. At the start of an operation, the voltage source continuously increases the supply voltage over an operating range assigned to it. When a constant total current flowing over the parallel circuit is reached, the current-carrying voltage source fixes the associated supply voltage and maintains it unaltered.

7 Claims, 1 Drawing Sheet

INTERCONNECTED ARRANGEMENT OF INDIVIDUAL MODULES HAVING AT LEAST ONE LIGHT-EMITTING DIODE CHIP

BACKGROUND OF THE INVENTION

The instant application should be granted the priority dates of Jan. 3, 2006, the filing date of the corresponding German patent application 10 2006 000 810.3 as well as Dec. 29, 2006 the filing date of the International patent application PCT/EP2006/012591.

The invention relates to an interconnected arrangement of a plurality of modules comprising at least one, but preferably a plurality, of light-emitting diode chips connected in series or in parallel. Such individual modules are, for example, known from the product data sheet "High Performance Square—built-in PCB lighting modules" of Vossloh-Schwabe Deutschland GmbH of 04/2005.

With individual modules as light sources operating on the basis of light-emitting diode chips there is the problem that the respective forward voltage range of the light-emitting diode chips used is dictated by the manufacturing process. The use of light-emitting diode chips with narrow forward voltage ranges may be implemented on an individual module or a plurality of individual modules. With mass production, however, the use of light-emitting diode chips selected only with a narrow, restricted forward voltage range is very uneconomical with regard to a plurality of manufactured modules.

Appropriately, therefore, forward voltage selected light-emitting diodes interconnected in parallel are only provided in switching systems located on individual modules. Such individual modules are stable per se. However, if a plurality of individual modules are connected in parallel in module arrangements interconnected to one another, individual current sources are respectively connected in series with the modules which are interconnected individually in parallel or in parallel series. These current sources stabilize the operation of the individual modules.

Such a connection in series of current sources and an associated LED module may be easily interconnected to module systems supplied by a supply voltage, with individual modules connected in parallel As the operating stability of an individual LED module is highly dependent on a low operating temperature, the respective current sources connected in series to the individual modules are generally arranged separately.

To this end, clocked current sources with high efficiency relative to the input voltage are used as well as linear operating current sources, for example in the form of transistor circuits which operate as "variable series resistors". With these linear current sources, however, the efficiency and thus the inherent heat dissipation is dependent on the delta of the input voltage to the control output voltage. A linear current source may, therefore, only be operated with high efficiency, i.e. low heat dissipation, when the input voltage is not much greater than the control output voltage.

Insofar as clocked current sources are independent of a defined input voltage, as might be necessary with linear systems, generally with known LED module systems connected in parallel, clocked current sources are exclusively used. The drawback associated with these clocked current sources, however, is that such current sources are substantially more complicated and thus more expensive than linear current sources.

An interconnected arrangement of light-emitting diode chips is already known from DE 103 18 780 A1, which are supplied by constant current circuits, the voltage source being set for the purpose of minimizing the heat dissipation in the linear controllers. However, it is therefore necessary to measure the voltage on all light-emitting diode chip arrangements and/or on all current sources.

The object of the invention, therefore, is to demonstrate a possibility of interconnecting in parallel individual modules comprising in particular a plurality of light-emitting diode chips, in which despite variable forward voltages on the modules to be interconnected to one another, linear current sources and/or linear constant current circuits may be used in a simple circuit construction.

SUMMARY OF THE INVENTION

To this end, the invention provides in detail that the light-emitting diode chip arrangements are respectively connected via a linear constant current circuit to a common current-carrying voltage source which, at the start of the operation, continually raises the supply voltage (U) via an operating range assigned thereto, and when reaching a constant total current flowing over the parallel circuit, fixes and maintains the associated supply voltage unaltered. Thus the invention is based on the idea that with light-emitting diode chip arrangements operated on a common current source and connected in parallel via linear constant current circuits, only the total current of the parallel connection has to be measured in order to set the supply voltage, whereby when switching on the current source, the supply voltage is fixed to a value from which the total current reaches a constant value.

The advantage associated with the invention is that for different modular circuits, only one single voltage source configured as a current-carrying voltage source has to be used and thus only has to be maintained, which covers the individual requirement for module-dependent forward voltages. A power factor correction circuit may be integrated into this current-carrying voltage source, if required. A further advantage is that in the event of failure of an individual module, a replacement module may be integrated into the circuit with a forward voltage which is variable due to the fitting or provision of light-emitting diode chips belonging to a different selection class, as the current-carrying voltage source automatically takes account of a different forward voltage occurring in the replacement module.

Insofar as it is provided according to an embodiment of the invention that the linear current source is arranged on every associated module and is connected in series with, and ahead of the light-emitting diode chip arrangement arranged on the individual module, the arrangement of the linear current sources on the individual modules themselves leads to a certain thermal load on the modules, but the heat generation occurring at maximum load of the current sources is relatively low and does not affect the subsequent light-emitting diode chips during normal operation, as the current-carrying voltage source only adjusts a supply voltage to the level of the maximum forward voltage provided with the individual modules interconnected with one another.

Alternatively, it may also be provided, however, that the linear current source is arranged separately from the module and is connected in series with and ahead of the individual module.

According to an embodiment of the invention it is provided that, in the event of the total current supplied dropping by a preset value at the current-carrying voltage source, the current-carrying voltage source is designed to switch off, immediately passing again through its operating range. Due to the fact that, in the event of failure of a module connected in parallel, the total current received drops, the current-carrying voltage source may set the voltage again to the maximum forward voltage of the remaining modules by switching off, immediately passing again through the operating range.

The same effect is produced if an overheating protection system associated respectively with the inserted linear constant current circuits or even an electronic overcurrent protection system is operational and switches off the current-carrying voltage source to protect the system. In this case, the current-carrying voltage source then immediately turns on the supply voltage again in order to supply the remaining modules with a supply voltage corresponding to the maximum forward voltage of the remaining modules in a controlled manner.

According to an embodiment of the invention it is provided that the operating range of the current-carrying voltage source corresponds to the safety extra low voltage range, it being able to be provided that the operating range of the current-carrying voltage source is 5 V to 35 V. However, the range of application of the invention and in particular a current-carrying voltage source is not restricted to the aforementioned voltage range but may also include higher voltages.

It may be provided that the current-carrying voltage source passes through the operating range during a preset time period, for example 250 ms, provided that the correction time is so short that light differences visible to the eye do not occur.

BRIEF DESCRIPTION OF THE DRAWINGS

An embodiment of the invention is reproduced in the drawings, in which.

DESCRIPTION OF PREFERRED EMBODIMENTS

Figure 1:
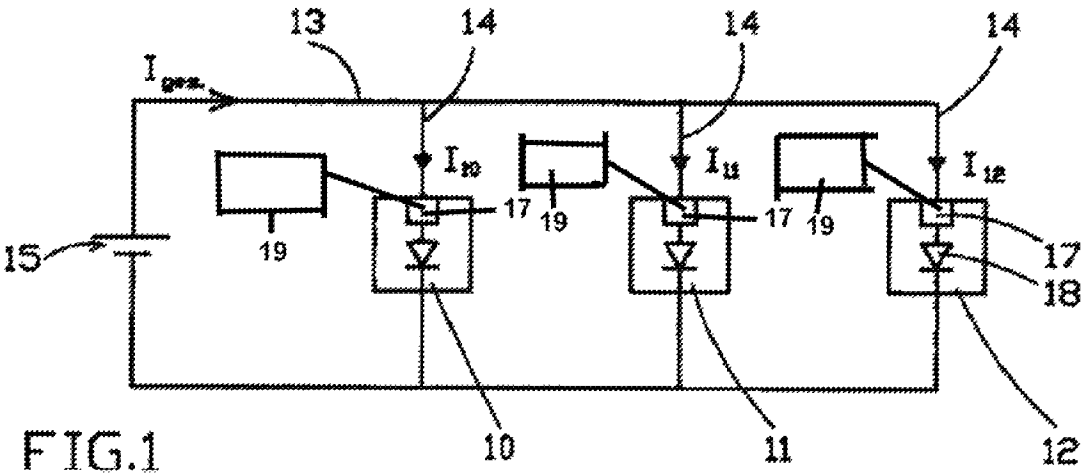
FIG. 1 is the arrangement of a plurality of modules connected to a common voltage source.

In FIG. 1, three modules 10, 11, 12 respectively provided with a light-emitting diode arrangement 18 are connected in parallel to a current-carrying voltage source 15. Accordingly, a total current $I_{ges}$ is in the line 13 coming from the voltage source 15, while the currents $I_{10}$, $I_{11}$, $I_{12}$ flow in the lines 14 connected in parallel with the associated modules 10, 11, 12. The circuit is only given by way of example; it may be extended by further modules, a restriction being possible in the layout of lines and switch connections required for a total current depending on the number of modules.

Every light-emitting diode arrangement 18 on every module 10, 11, 12 in the embodiment shown comprises five light-emitting diode chips arranged in series. In this connection it may be assumed that the light-emitting diode chips located on the module 10 may be assigned to the selection class of 3.2 V with regard to their forward voltage; resulting therefore in a module-related forward voltage of 16 V. Insofar as a difference in forward voltage of 0.1 V is permissible on the light-emitting diode chips in the context of such a selection class, allowing for the addition of errors, a module-related forward voltage of 16.5 V can result. Based on a selection class of 3.3 V of the light-emitting diode chips used, for the module 11, accordingly a module-related forward voltage of 17 V results and accordingly with light-emitting diode chips of the selection class 3.4 V, a forward voltage of 17.5 V results with the module 12.

Thus the voltage difference is 1.5 V in the maximally occurring module-related forward voltages. In order to compensate for the aforementioned voltage differences in the current supply of the light-emitting diode chips located on the modules, a linear current source is arranged on each of the modules 10, 11, 12 configured as a constant current circuit 17. The current controller "MAX 16800" of Maxim Integrated Products, Sunnyvale, USA could be used as associated current sources, for example, which are designed to control a constant current of 350 mA. This current of 350 mA corresponds, for example, to an operating current for operating light-emitting diode chips of the aforementioned type to reach a predetermined brightness. The current sources used would generate heat dissipation of 0.875 W with control of the aforementioned 1.5 V voltage differences and power consumption of 1V at 350 mA, which accumulates as heat. Such a thermal load on a module may be regarded as being in the permissible range. Instead of the aforementioned current controller, other linear current sources or linear current source systems may also be used.

Figure 2:
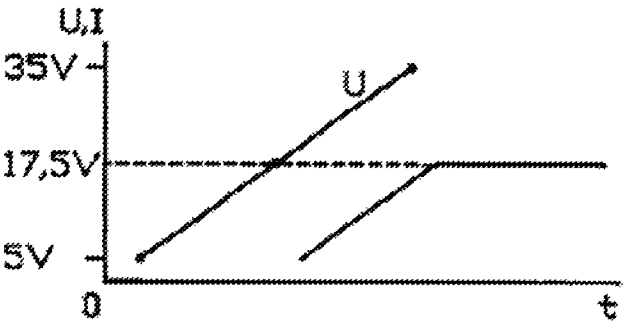
FIG. 2 is the function of the current-carrying voltage source provided in a schematic voltage/current time diagram.

If the module arrangement shown in FIG. 1 is operated with the individual modules 10, 11, 12 interconnected to one another in parallel, the current-carrying voltage source 15, when connected to a power supply, passes through the operating range assigned thereto of, for example, 5 V to 35 V within the safety extra low voltage range, over a correspondingly fixed control time period of, for example, 250 ms. The current $I_{ges}$ received by all the modules 10, 11, 12, follows the rising voltage of the current-carrying voltage source 15. As soon as the total current $I_{ges}$ reaches a constant value, which corresponds to the current requirement $I_{10}$, $I_{11}$, $I_{12}$ of the interconnected modules 10, 11, 12, the current-carrying voltage source 15 remains at the voltage value corresponding to the current requirement $I_{ges}$ and maintains this supply voltage. As it is, therefore, the maximum module-related forward voltage applied to one of the modules 10, 11, 12, the constant current circuits 17 located on the modules 10, 11, 12 control forward voltages occurring on the modules which are too high. In the diagram shown in FIG. 2 with reference to the embodiment disclosed in FIG. 1, the supply voltage is 17.5 V corresponding to the maximum forward voltage occurring on the module 10 in the present example.

It may, on the one hand, be provided that in the event of failure of one of the modules 10, 11, 12, the dropping current flow $I_{ges}$ leads to the switching off of the current-carrying voltage source 15, but immediately after the switch-off the current-carrying voltage source 15 again passes through its operating range between, for example, 5 V and 35 V and thus the new supply voltage accordingly sets the voltage requirement of the remaining modules and maintains the voltage requirement. Similarly, this procedure may be provided when an overheating protection system, which is represented by the blocks 19 and is installed on the linear constant current circuits 17, or an electronic overcurrent protection system, is operational and switches off the current-carrying voltage source 15.

Even in this case, the current-carrying voltage source is intended to be immediately switched on again and maintained at the supply voltage defined by the maximum forward voltage applied to the remaining modules.

The features of the subject matter of these documents disclosed in the above description, claims, abstract and drawings may form the basis, either individually or in any combination, for the realization of the invention in its different embodiments.

The specification incorporates by reference the disclosure of German 10 2006 000 810.3 filed Jan. 3, 2006 and International application PCT/EP2006/012591 filed Dec. 29, 2006.

The present invention is, of course, in no way restricted to the specific disclosure of the specification and drawings, but also encompasses any modifications within the scope of the appended claims.

The invention claimed is:

1. An interconnected arrangement of at least two light-emitting diode chip arrangements having individual modules as luminous elements in a parallel circuit, wherein each of said individual modules is provided with at least one light-emitting diode chip, and said modules are arranged in a parallel circuit, said arrangement further comprising:

a single, common, current-carrying voltage source; and a respective linear constant current circuit for each of said light-emitting diode chip arrangements, wherein each of said light-emitting diode chip arrangements is connected to said common, current-carrying voltage source via said constant current circuit, further wherein said common voltage source is configured to provide to each of said constant current circuits the same voltage, further wherein at the start of an operation said voltage source continuously increases a supply voltage over an operating range assigned to said voltage source, and wherein when a constant total current flowing over the parallel circuit is reached, said common, current-carrying voltage source fixes the associated supply voltage and maintains said supply voltage unaltered, wherein if the total current that is supplied drops by a preset value at said common, current-carrying voltage source, said voltage source is configured to switch off and to immediately again increase the supply voltage over the operating range of said voltage source.

2. The interconnected module arrangement according to claim 1, wherein each of said constant current circuits is disposed on a respective one of said individual modules and is connected in series with and ahead of the light-emitting diode chip arrangement disposed on that individual module.

3. The interconnected module arrangement according to claim 1, wherein each of said constant current circuits is arranged separately from a respective one of said individual modules and is connected in series with and ahead of such individual module.

4. The interconnected module arrangement according to claim 1, wherein the operating range of said common, current-carrying voltage source corresponds to a safety extra low voltage range.

5. The interconnected module arrangement according to claim 4, wherein the operating range of said common, current-carrying voltage source is 5V to 35V.

6. An interconnected arrangement of at least two light-emitting diode chip arrangements having individual modules as luminous elements in a parallel circuit, wherein each of said individual modules is provided with at least one light-emitting diode chip, and said modules are arranged in a parallel circuit, said arrangement further comprising:

a single, common, current-carrying voltage source; and a respective linear constant current circuit for each of said light-emitting diode chip arrangements, wherein each of said light-emitting diode chip arrangements is connected to said common, current-carrying voltage source via said constant current circuit, further wherein said common voltage source is configured to provide to each of said constant current circuits the same voltage, further wherein at the start of an operation said voltage source continuously increases a supply voltage over an operating range assigned to said voltage source, and wherein when a constant total current flowing over the parallel circuit is reached, said common, current-carrying voltage source fixes the associated supply voltage and maintains said supply voltage unaltered, wherein an overheating protection system is disposed on said linear constant current circuits that are associated with said individual modules, and wherein said protection system is configured to switch off said common, current-carrying voltage source and to provide for said voltage source to again immediately increase the supply voltage over the operating range of said voltage source.

7. An interconnected arrangement of at least two light-emitting diode chip arrangements having individual modules as luminous elements in a parallel circuit, wherein each of said individual modules is provided with at least one light-emitting diode chip, and said modules are arranged in a parallel circuit, said arrangement further comprising:

a single, common, current-carrying voltage source; and a respective linear constant current circuit for each of said light-emitting diode chip arrangements, wherein each of said light-emitting diode chip arrangements is connected to said common, current-carrying voltage source via said constant current circuit, further wherein said common voltage source is configured to provide to each of said constant current circuits the same voltage, further wherein at the start of an operation said voltage source continuously increases a supply voltage over an operating range assigned to said voltage source, and wherein when a constant total current flowing over the parallel circuit is reached, said common, current-carrying voltage source fixes the associated supply voltage and maintains said supply voltage unaltered, wherein said common, current-carrying voltage source is adapted to increase the supply voltage over the operating range of said voltage source during a preset time period, wherein said preset time period is 250 ms.

* * * * *